United States Patent [19]

Takada et al.

[11] Patent Number: 4,972,921

[45] Date of Patent: Nov. 27, 1990

[54] MUFFLER FOR INTERNAL COMBUSTION ENGINES

[75] Inventors: Toshiyuki Takada, Miki; Hisayoshi Shibata, Akashi, both of Japan

[73] Assignee: Kawasaki Jukogyo Kabushiki Kaisha, Japan

[21] Appl. No.: 366,782

[22] Filed: Jun. 15, 1989

[30] Foreign Application Priority Data

Jun. 16, 1988 [JP] Japan ..... 63-79597[U]

[51] Int. Cl.[5] ..... F01N 1/08

[52] U.S. Cl. ..... 181/282; 181/240; 181/243; 181/264; 181/265; 181/272

[58] Field of Search ..... 181/240, 243, 250, 255, 181/264, 265, 269, 272, 282

[56] References Cited

U.S. PATENT DOCUMENTS

| | | | |
|---|---|---|---|
| 1,822,990 | 9/1931 | Gorsline | 181/264 |
| 3,709,320 | 1/1973 | Hollerl et al. | 181/240 |
| 3,968,854 | 7/1976 | Gordon et al. | 181/269 |
| 3,987,868 | 10/1976 | Betts | 181/269 |
| 4,132,286 | 1/1979 | Hasui et al. | 181/265 |
| 4,415,059 | 11/1983 | Hayashi | 181/250 |

*Primary Examiner*—Benjamin R. Fuller

[57] ABSTRACT

An improved muffler of relatively large size for internal combustion engines is shown, which comprises a main hollow shell, assembled from half sections with caulked flanges to join the sections together into an airtight enclosure, at least one perforated baffle plate having its periphery clamped between the opposite edges, exhaust inlet and outlet ports. The baffle plate is bent into a curve defining in the inside of the shell chambers differing in volume from one another, through which the exhaust gases from an engine are forced to flow so that the gases alternately expand and contract. In addition to the rigid integration of the baffle plate with the shell by caulking, various interlocking and elastic members rigidly interconnect between the plate and the inside walls of the shell in such a manner as to reduce development or transmission of the vibrations in the shell components due to the pressure oscillations of the exhaust gases. Furthermore, an anti-skid stopper is formed in the baffle plate adjacent to the periphery to be caulked to stand to abut the side of the half section thereby prevent the associated edge being caulked from falling off from engagement with the other edge when caulking pressures are being applied to the edges.

5 Claims, 10 Drawing Sheets

MUFFLER FOR INTERNAL COMBUSTION ENGINES

BACKGROUND OF THE INVENTION

1) Field of the Invention

The present invention relates in general to a muffler for internal combustion engines. More particularly, the present invention relates to the structure of such a muffler comprised of a hollow box-shaped body, which is assembled from half shell sections of similar shape each with flanges contacted together to hold the sections into an airtight enclosed shell, and at least one perforated baffle plate mounted in the shell with its periphery interposed between the flanges.

(2) Description of the Prior Art

Various types of mufflers for internal combustion engines have been developed which are relatively small and comprise an airtight enclosed hollow body having baffle plates to divide the interior into chambers and an inlet port connected to the exhaust duct of an engine. The divided chambers are defined such as to achieve a reduction in both the noise and pulsating pressures of the exhaust gases from the engine by allowing them to pass through the perforations of the baffle plates.

Such a muffler is disclosed, for example, in U.S. Pat. No. 3,968,854 by Gordon et al, U.S. Pat. No. 3, 987,868 by Betts, U.S. Pat. No. 4,132,286 by Hasui et al, laid-open Japanese utility model applications Nos. 56-17314, 56-83628 and 56-149107.

DISCLOSURE STATEMENT

Gordon et al proposes a muffler for smaller engines which is designed to achieve a reduction in the engine exhaust noise by allowing the exhaust gases to flow through an elongated passage that is divided into chambers between an exhaust gas inlet and outlet ports of the muffler shell. The muffler developed by Betts is of a hollow structure having therein a conical element arranged to attenuate the exhaust noise of an engine by allowing the exhaust gases to pass through the element. Hasui et al discloses a muffler which reduces the noise of engine exhaust by permitting exhaust gases to flow through perforated baffle members mounted between an exhaust inlet and outlet ports of the muffler body case. As will be made clear from the detailed description of the present invention that follow, this invention is not anticipated by none of the above identified U.S. patents and Japanese utility model applications.

Mufflers are assembled, in a variety of methods ranging from welding to bolting and caulking, generally from a thin-walled shell body of cylindrical or box-like configuration and also thin-walled performed baffle structures mounted between an exhaust gas inlet and outlet ports formed in the shell body, the shell and baffle structures normally formed by stamping or other press forming method. A reduction in the noise of the engine exhaust gases is achieved by allowing them to pass through the perforated structures. The pressure pulsations of the exhaust gases, which produce explosive noise, undergo reduction as the exhaust gases alternately contract and expand as they are forced through the narrow holes in the perforated structures. Developments have so far been proposed in the prior art to increase the muffling effect by enlarging the muffler housing interior. However, these mufflers have been found to pose new problems because of their increased dimensions. The shell and perforated baffle plates of these mufflers have resulted in having a widened surface area subject to a correspondingly greater amount of vibration in themselves developed by the pressure oscillations of the engine exhaust.

Various attempts have been made to eliminate the above-mentioned problem. In one such an improvement, the shell and perforated baffle plates have increased wall-thickness so as to minimize development of vibrations. In another proposal, the muffler components are lined with an acoustic material such as glass wool. However, these attempts in the prior art mufflers have not been widely accepted for commercial reasons because of an accompanying increase in both manufacturing cost and overall product weight.

In some mufflers, which are assembled from half shell sections into an airtight tubular or box-like shell body, the half sections are bonded together, with perforated baffle plates interposed between the sections, by caulking along contacted flanges formed in the periphery of each section. Eliminating welding operations, this assembling method enables mufflers to be produced at low cost.

However, with larger mufflers, caulking has tended to pose certain serious difficulty. Caulking pressures applied, as by caulking rollers, to the contacted flanged edges of the half shell sections to compress one edge over other have tended to cause the muffler shell side adjacent to that portion of one of the flanged edges now being caulked to move away from the other flanged edge, particularly often at midpoint of the shell sides. As a result, the muffler produced comes out as incompletely caulked or, in an extreme case, the contacted flanges having a seam partly uncaulked with subsequent leak possibilities.

SUMMARY OF THE INVENTION

The present invention has been proposed to eliminate the above-mentioned disadvantages of the prior art mufflers.

It is therefore a primary object of the present invention to provide an improved muffler for internal combustion engine which has a solid structure built to reduce development of vibrations in the muffler components due to the pressure oscillations of the exhaust gases.

It is a further object of the present invention to provide the structure of a muffler that facilitates construction by caulking.

The present invention proposes a muffler of relatively large configuration comprising main shell, perforated baffle plates and reinforcement members. The main body is assembled from two half shell sections making up a rectangular box-like shell, with an exhaust inlet and outlet ports. The baffle plates, preferably produced by stamping or other press forming, are curved and situated in the muffler shell in such a manner as to define chambers differing in volume from each other so that the exhaust gases entering the muffler alternately contract and expand as they flow from chamber to chamber. The half shell sections each have flanges, and built into a whole shell by bonding the flanges, with the peripheries of the baffle plates interposed there between, preferably by caulking to insure solid interlocking relationship between the parts enough to lessen development of vibrations due to the pulsating pressures of the exhaust gases.

Furthermore, the solid construction of the overall muffler structure is enhanced by an interlocking coupling of the baffle plates with the wall of the shell. For example, a dome-like bulge is formed in the baffle plate, and is press fitted into a recess defined in the wall of the half shell section. In another proposed improvement a baffle plate is bent to a curve such as to be able to elastically dampen the vibrations being developed or transmitted to them by the exhaust pressure oscillations.

Reinforcement members are installed to interlockingly join the shell components in such a manner that helps to attenuate the vibrations transmitted to them by the violent exhaust pressure pulsations. For example, the outlet port in the shell is engaged with the outlet opening in the chamber defined at the exit end of the baffle plate complex into an integrated rim, insuring a rigidly interlocked structure. In another embodiment, a reinforcement member of tubular configuration is installed around the bolt holes, through which bolts secure the muffler to a vehicle surface, in such a manner to increase rigidity by being sturdily secured to both the baffle structure and the shell. In a still further embodiment, a compression spring is installed between the baffle plates in such a manner as to dampen transmission of exhaust gas-induced vibrations between the plates.

Also, an additional improvement is proposed for mufflers of the type which is fabricated from half sections with overlapped flanged edges by applying caulking pressures to the edges into an airtight enclosure, with the external periphery of a perforated structure being held sandwiched between the opposited edges. The baffle structure is provided with an anti-slip projection formed adjacent to the periphery to be clamped by the edges by caulking. The projection serves to abut against the inside wall of the shell side where the associated flanged edge is subjected to caulking pressures, thereby preventing inward deformation of the side due to the very pressures. This arrangement not only would insure proper caulking by helping to holding the edges fixed in caulked positions. It would also serve to prevent occurrence of incompletely caulked or uncaulked seams between the enclosed shell body assembled.

The above and other projects, features and advantages of the present invention will be apparent from the following description and appended claims taken in reference to the accompanying drawings.

BRIEF EXPLANATION OF ATTACHED DRAWINGS

DETAILED DESCRIPTION OF THE INVENTION

Preferred embodiment of the present invention will be described in full detail in conjunction with the attached embodiments.

Figure 1:
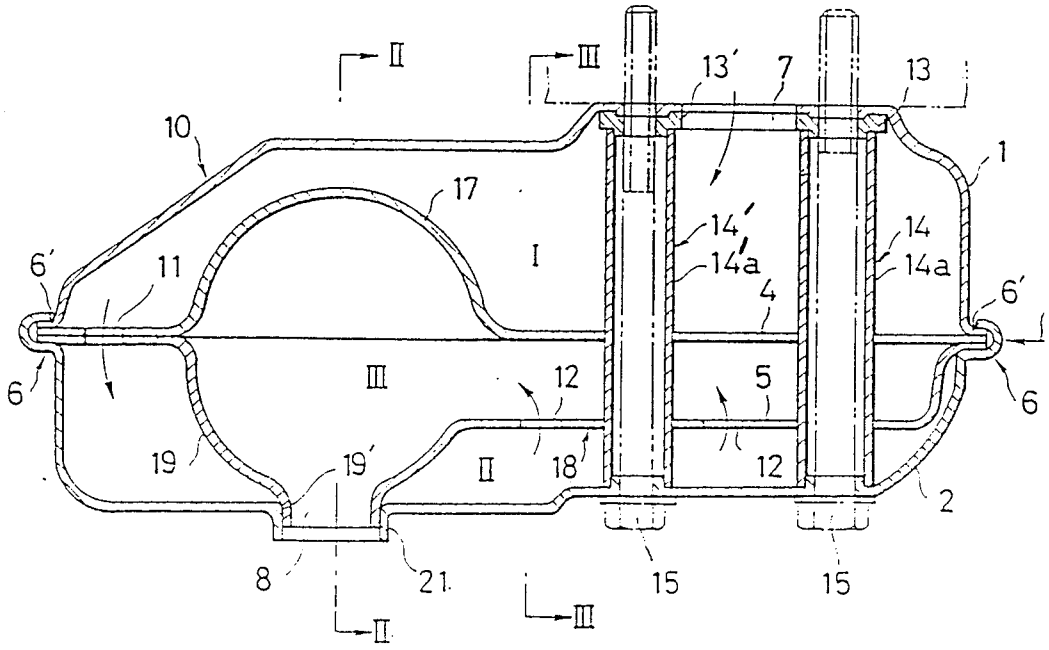
FIG. 1 is a side cross-sectional view of a first preferred embodiment of a muffler constructed in accordance with the present invention.
Figure 2:
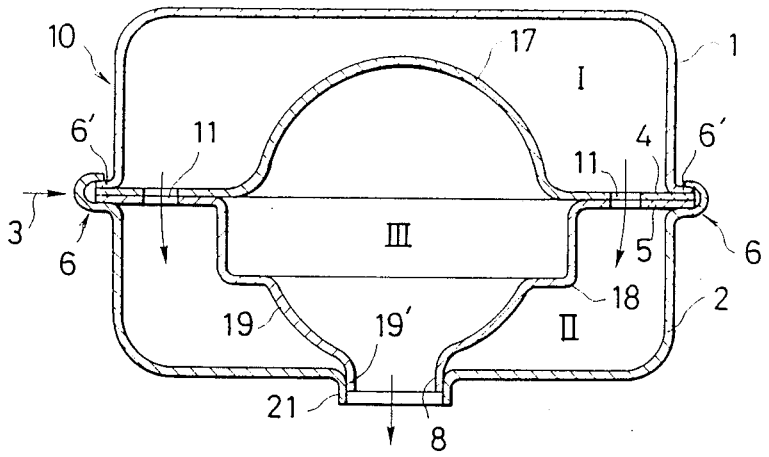
FIG. 2 is a sectional view taken along the line II—II of FIG. 1.
Figure 3:
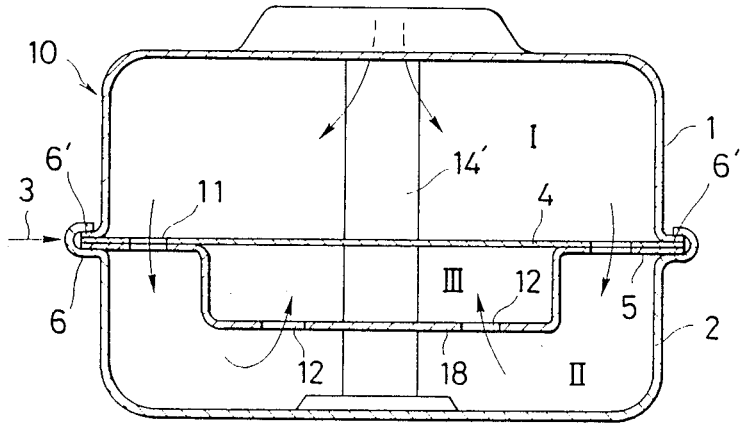
FIG. 3 is a sectional view taken along the line III—III of FIG. 1.

Referring first FIGS. 1, 2 and 3, which are each showing a first preferred embodiment of a muffler 10 for internal combustion engines built in accordance with the present invention, a pair of an upper shell portion 1 and a lower shell portion 2 that make up in combination the muffler of a hollow, largely rectangular configuration are shown. The upper shell portion 1 is provided along its open end with a flange 6'. Also, an upturned flange 6 is formed in the open end of the lower shell section. The upper and lower shell sections 4 and 5 are joined together into an airtight enclosed shell by sealing the flanges 6 and 6'. This sealing may preferably be done by caulking, or applying pressure across the fold of the upturned flange 6', with the flat flange 6 held inserted into the other flange.

The muffler 10 is provided with an exhaust inlet port 7 bored in the upper shell portion 1 to receive the exhaust gases from an internal combustion engine, not shown, into the muffler through an exhaust duct, not shown, that is coupled in fluid-flow relation with the inlet port. Also, an exhaust outlet port 8 is formed in the lower shell section 2 to permit the escape of the exhaust gases in the muffler 10 into the atmosphere.

Also, the muffler includes a perforated baffle structure which may be a pair of an upper baffle plate 4 and a lower baffle plate 5. The upper baffle plate 4 is mounted to extend transverse to define a chamber 1 in an upper portion of the hollow muffler 10. Also, the lower baffle plate 5 extends across the muffler 10, with an external peripheral portion thereof being closely contacted with a peripheral portion of the upper baffle plate 4, between the opposite flanges 6 and 6' of the shell sections 1 and 2, respectively.

In addition, the upper baffle plate 4 has an upper semi-spherical bulge 17 in a front portion thereof. Likewise, in the middle of the lower baffle plate 5 is formed a lower semi-spherical bulge 19 that is located opposite the upper bulge 17. Preferably, the upper bulge 17 is formed to measure as wide in diameter across its base as the lower bulge 19. The upper and lower bulges 17 and 19 overlap with each other end-to-end to form a largely spherical space in the center of the muffler shell between the upper and lower baffle plates 4 and 5. Also, the lower baffle plate 5 has a centrally extending, elongate swell 18 immediately adjacent to the lower bulge 19. As a result, the upper and lower spherical bulges 17 and 19 merge the elongate swell 18 to form a chamber III between the upper and lower baffle plates 4 and 5.

The upper baffle plate 4 may preferably be overlapped at a front end thereof with the lower baffle plate 5 on the opposite side of the chamber III to the elongate swell 18. In this overlapped portion are bored a plurality of perforations 11 to establish fluid-flow communication between the chamber I and chamber II. Although only a pair of perforations 11 are shown in FIG. 2, it is to be noted that the invention should not be limited to this number. In addition, the lower baffle plate 5 has a plurality of perforations 12 formed in the elongate swell 18 to bring the chamber II into fluid-flow relationship with the chamber III. Again, the number of perforations 12 is a matter of choice, without being bounded by the illustration shown. Furthermore, the lower baffle plate 5 has an aperture 19' opened at a top end of the semi-spherical bulge 19, at a location just opposite the exhaust outlet port 8. An annular sleeve 21 extends from the rim of the aperture 19' into the exhaust outlet port 8, opening the chamber III to the atmosphere. The sleeve 21 may preferably be sized so as to fittingly engage with the rim of the outlet port 8. This tight engagement is provided to give the lower baffle plate 5 interlocking rigidity with the lower shell section 2 at the lower bulge 19 through its sleeve portion 21.

With the above-mentioned arrangement of internal space division in the muffler 10, the exhaust gases from the exhaust duct, not shown, enters the chamber I at the exhaust inlet port 7. Then, the gases are, on the momentum of their explosive propulsion, forced through the narrow passage defined between the upper bulge 17 and the inside walls of the upper shell section 1 to rush into that remoter end of the chamber I which are separated by the bulge 17 from the rest of the chamber I. Leaving the chamber I, the gases then pass through the perforations 11 into the chamber II where the flow is again forced through the confined passage between the lower bulge 19 and the inside walls of the lower shell section 2. The gases advance from the chamber II into the chamber III through the perforations, and finding their way to the opening 19', are allowed to go out into the atmosphere through the exhaust outlet port 8.

In this way, in the process of flowing from chamber to chamber in the muffler 10 through the narrow passages defined in them, the exhaust gases alternate in itself expansion and contraction because of the their difference in cubic volume, with the result that the gases reduce in both propulsive force and pulsation pressure.

The muffler 10 may be installed on a vehicle with bolts 15. A pair of bolt holes 14 and 14' are provided for bolting the muffler body, and may be disposed in a longitudinal row. The bolt holes 14 and 14' extend through a pair of holes bored in the upper and lower baffle plates 4 and 5, respectively. The inside wall of each of the bolt holes 14 and 14' may be made of tubular reinforcing members **14*a* and 14'*a* that extend full way from end to end in the muffler body 10. The reinforcing members 14*a* and 14'*a* may be provided at their top end with collars 13 and 13' that are fixedly secured to the top wall of the upper shell section 1. The collars 13 and 13' are provided to give the reinforcing members 14*a* and 14'*a* interlocking rigidity with the upper shell section 1. The upper and lower plates 4 and 5 each may preferably have their bores for the bolt holes 14 and 14' sized so as to permit the fitting insertion of the reinforcing members 14*a* and 14'*a*** for increased interlocking relation in the overall muffler structure.

The first embodiment described above with reference to FIGS. 1, 2 and 3 offers basic features of the present invention, which can be summarized as follows:

First, most of the muffler parts, including the two baffle plates 4 and 5 and the upper and lower shell sections 1 and 2, can be produced by stamping or other press forming, and assembled into a complete muffler body by caulking alone, without having recourse to welding or bolting. This feature means lower manufacturing cost and, because of use of caulking, enhanced assembly efficiency.

Secondly, the internal parts are braced in themselves and with one another into a rigid interlocking structure at important points so that the muffler body 10 is less subject to violent vibration due to the pressure oscillations of the exhaust gases flowing through the inside separated spaces of the muffler 10. The isolated spaces in each of the longitudinally extended chambers I and II by the spherical bulges 17 and 19, along with the narrow passages defined between the upper and lower bulges and the inside muffler shell walls, cause the exhaust gases to undergo alternate expansion and reduction, with a resultant attenuation of pressure pulsation. Also, the curve of the thin-walled upper and lower bulges 17 and 19 offers enough resiliency to absorb the vibrations developed by the pulsating engine exhaust, preventing transmission of oscillations through the upper and lower baffle plates 4 and 5.

It must be understood that the other illustrated embodiments of this invention which will be discussed should be considered to be invested with part or all of the above-mentioned basic features of the first embodiment unless otherwise described.

Figure 4:
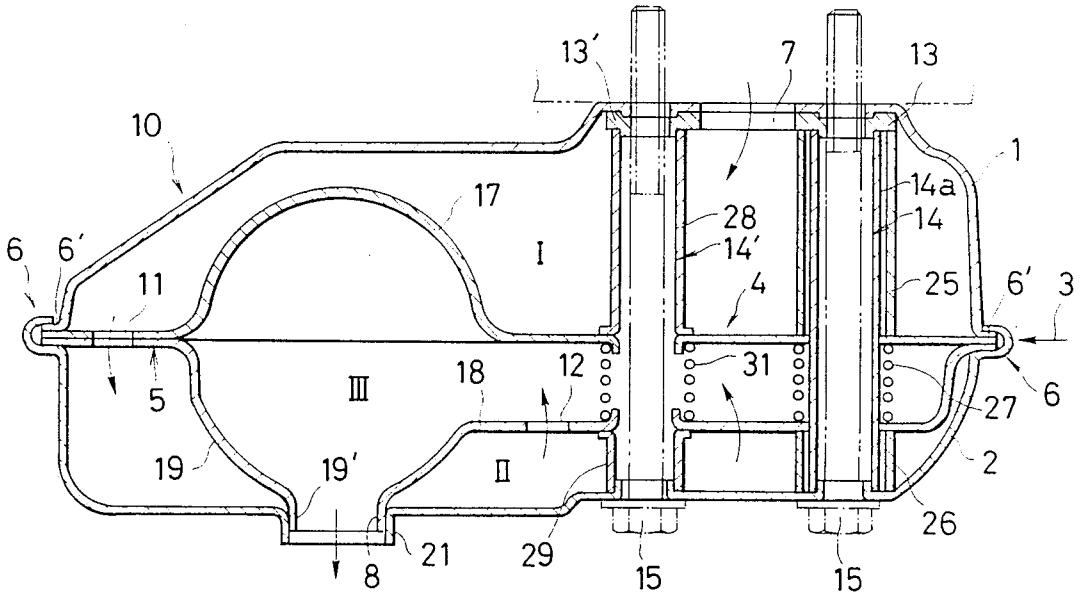
FIG. 4 is a side cross-sectional view of a second preferred embodiment of a muffler build according to the present invention.

Referring then to FIG. 4, another embodiment of the present invention will be described, in which like numerals indicate like parts.

A pair of vertical tubular strutting members 25 and 26 are provided mounted about the reinforcing members **14*a* on opposite sides of the elongate swell 18. The upper strutting member 25 extends to have its uppermost and lowermost ends to abut against the collar 13 and the top surface of the upper baffle plate 4, respectively. Likewise, the lower strutting member 26 is mounted to bring its uppermost and lowermost ends into abutting relation with the bottom surface of the lower baffle plate 5 and the inside bottom wall of the lower shell section 2**, respectively. This arrangement is intended to contribute to increasing the interlocking rigidity of the overall muffler structure.

Also, a compression spring 27 is mounted interposed between the upper strutting member 25 and lower strutting member 26. Another compression spring 31 is mounted about the bolt hole 14' between the upper baffle plate 4 and lower baffle plate 5. The installation of the springs 27 and 31 is aimed to establish between the upper and lower baffle plates 4 and 5 a resilient relationship that enables them to absorb vibrations developed by the exhaust gases flooding the chambers I, II and III.

In this embodiment, the reinforcing member **14'*a* of the first embodiment of FIG. 1 is replaced by a pair of upper and lower tubular strutting members 28 and 29 that are installed in vertical positions on both sides of the elongate swell 18. Like its counterpart 25 about the reinforcing member 14*a*, the upper strutting member 28** extends to have its uppermost and lowermost ends to abut against the collar 13' and the top surface of the upper baffle plate 4. Similarly, upper and lower ends of the lower strutting member 29 abut against the bottom side of the lower baffle plate 5 and the bottom wall surface of the lower shell section 2, respectively. The strutting members 28 and 29 are provided to compensate for the absence of the reinforcing member 14'*a* (FIG. 1) to insure the interlocking rigidity of the muffler structure. Furthermore, the bolt hole 14' is not shielded at a lower portion thereof where it is surrounded by the spring 31 alone. Therefore, to prevent leakage of the exhaust gases in the chamber III, sealing of the bolt hole 14' at its opposite end openings must be increased more that with the other bolt hole 14.

In other respects, this embodiment is substantially similar to the previous embodiment. In the embodiment of FIG. 4, the bolt holes 14 and 14' have a different arrangement of reinforcement from each other. However, this is a matter of choice, and the bolt holes 14 and 14' may be reinforced in the opposite manner to the illustration or both in the same setup.

Figure 5:
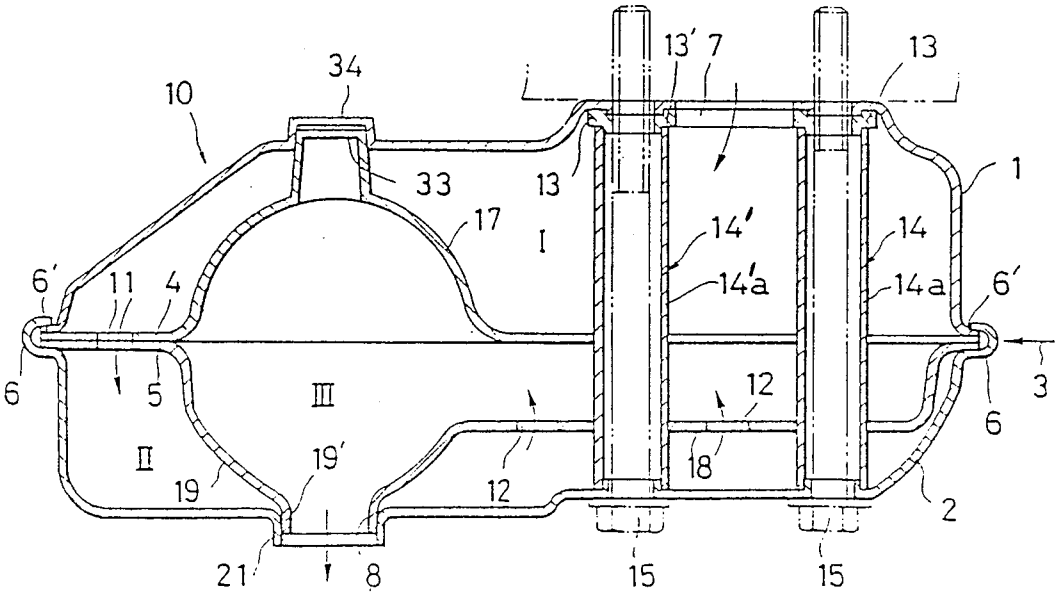
FIG. 5 is a side cross-sectional view of a third preferred embodiment of a muffler developed in accordance to the present invention.

FIG. 5 illustrates a third embodiment of the present invention, in which like parts are referred to by like numerals. The upper baffle plate 4 has a dome-like swell 33 formed in the upper spherical bulge 17. Also, in the top wall of the upper shell section 1 is defined a recess 34 at a location just opposite the swell 33. The recess 34 is so sized that it fittingly receives therein the swell 33. Again, this interlocking arrangement is provided to brace the upper baffle plate 4 in a rigid relationship with the muffler shell. In other points, this embodiment shares essentially identical features with the embodiment of FIG. 1.

Figure 6:
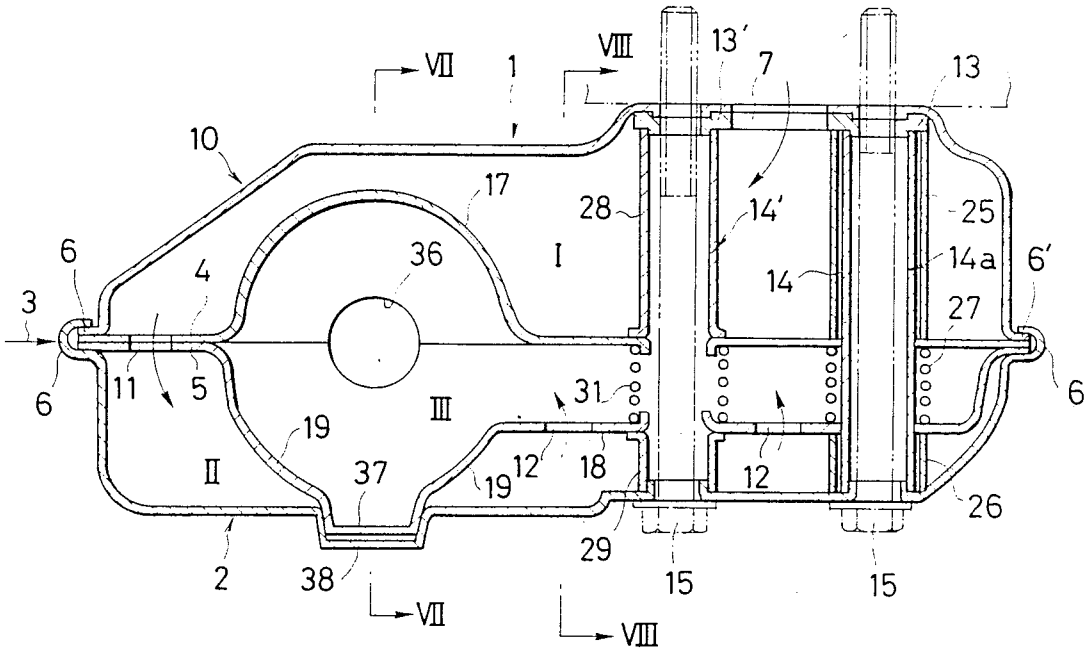
FIG. 6 is a side cross-sectional view of a muffler designed according to the present invention.
Figure 7:
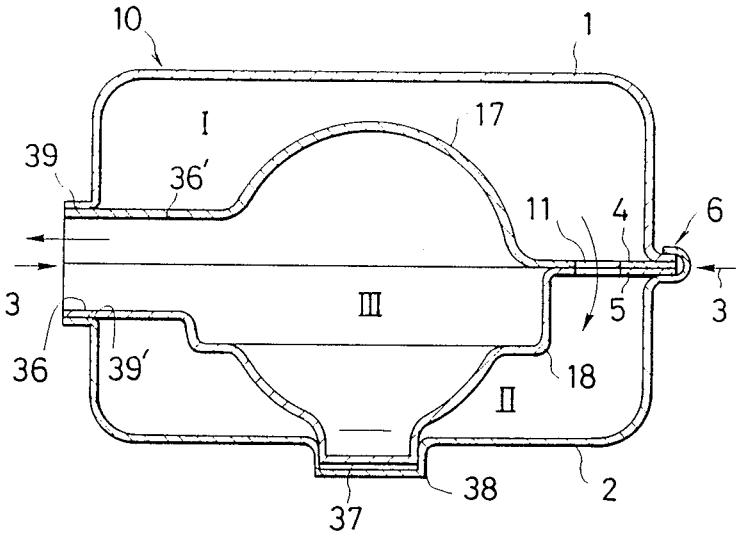
FIG. 7 is a sectional view taken along the line VII—VII of FIG. 6.
Figure 8:
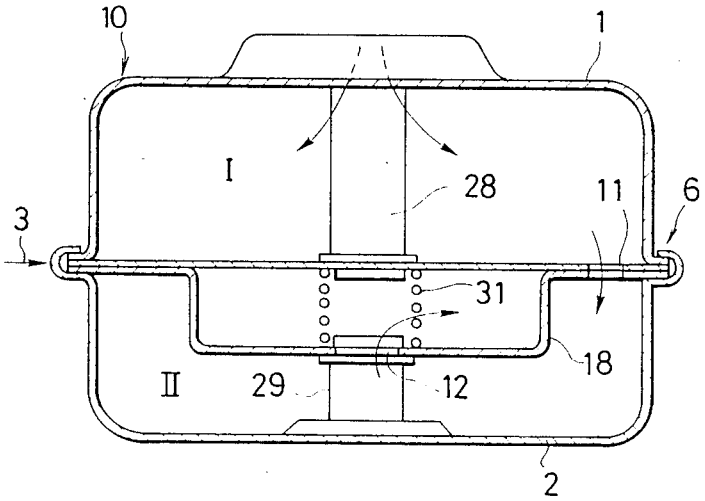
FIG. 8 is a sectional view taken along the line VIII—VIII of FIG. 6.

Referring now to FIGS. 6, 7 and 8, which depict different views of a fourth embodiment of the present invention, the muffler 10 depicted is similar in construction to the embodiment of FIG. 4 except for a few major points. Accordingly, the description will be limited to differences alone in order to avoid unnecessary repetition. Where like numerals are used, reference should be made to the description made in association with FIG. 4. As in the case of the FIG. 4 embodiment, the interlocking setup developed about the bolt hole 14 may be used for the other bolt hole 14'. Similarly, the same setup may be build about both the bolt holes 14 and 14'.

As shown, a major departure from FIG. 4 is the removal of the exhaust outlet port 8 from the bottom of the muffler 10. Accordingly, the lower spherical bulge 19 is devoid of the opening of FIG. 1. The lower baffle plate 5 has a dome-like swell 37 formed in the lower bulge 19. Also, in the bottom wall of the lower shell section 2 is defined a recess 38 at a location just opposite the swell 37. The diameter of the recess 38 may preferably be sized across its base so that it fittingly receives therein the swell 37. This arrangement is provided to hold the lower baffle plate 5, along with the lower bulge 19, in interlocking rigid structure with the muffler shell.

As can best be depicted in FIG. 7, behind their respective spherical bulges 17 and]19, the upper and lower baffle plates 4 and 5 extend toward one side of the muffler body 10 to form in combination a largely cylindrical sleeve 36' that have its forward end to define a circular opening 36. Also, across the upper and lower shell sections 1 and 2 is defined an aperture 39' just opposite the opening 36. The diameter of the apertyre 39° is so sized that the aperture fittingly received therein a front end portion of the sleeve 39' to form an exhaust outlet port 39, opening the chamber III to the atmosphere. Adjacent to its opening 36, the sleeve 36' may preferably be fixedly secured to a flange formed along the rim of the aperture 39'.

As with the previous embodiments, the muffler according to the fourth embodiment can be assembled by caulking alone, hence at lower cost than would be produced with the additional aid of welding work. Furthermore, it will be appreciated the interlocked relationship developed by caulking between the major muffler components, which can be achieved in an easy manner and an simple construction, would contribute to increasing the structural rigidity of the muffler 10. This helps to reduce development of vibrations in the muffler due to the pressure oscillations of the exhaust gases.

In the embodiment of FIG. 6, the interlocking arrangement of the swell 37 and recess 38 is in the lower bulge 19 and the bottom wall of the lower shell section 2. However, alternatively, a similar arrangement may be formed between the upper bulge 17 and the top wall of the upper shell section 1 as well. In a still alternative modification, this arrangement may be provided between the upper bulge 17 and the upper shell section 1 alone.

Furthermore, the exhaust outlet port 39 is disposed across the upper shell section 1 and lower shell section 2. However, in an alternative modification the port 39 may be defined in either the first shell section 1 alone in the lower shell section 2, with the addition of other necessary changes to be made in line with the port relocation.

Figure 9:
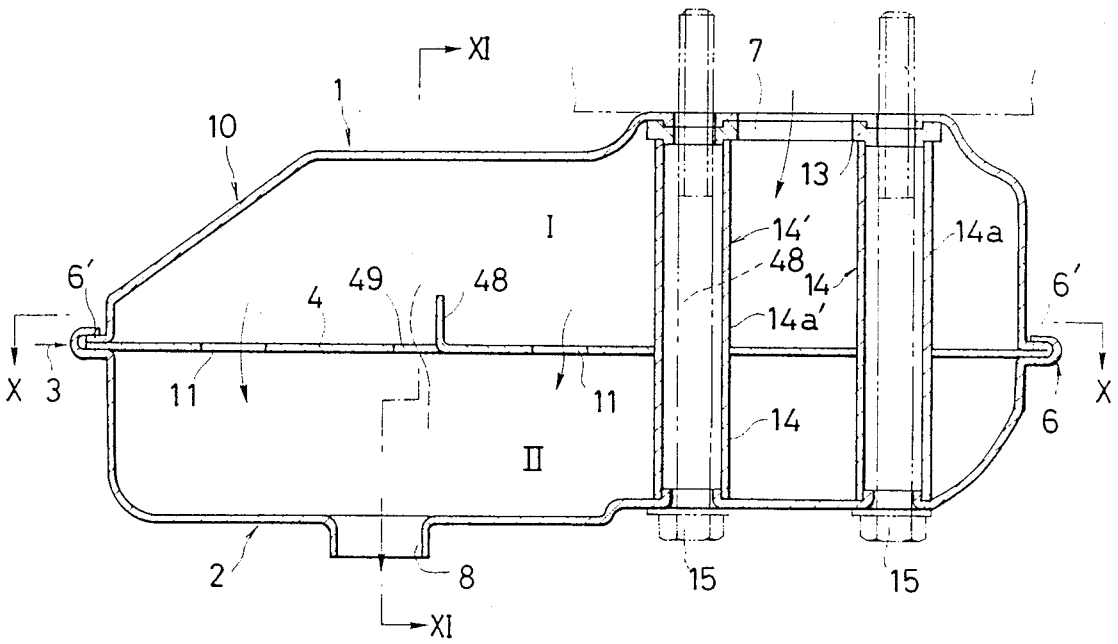
FIG. 9 is a side cross-sectional view of a further embodiment of a muffler built in accordance with the present invention.
Figure 10:
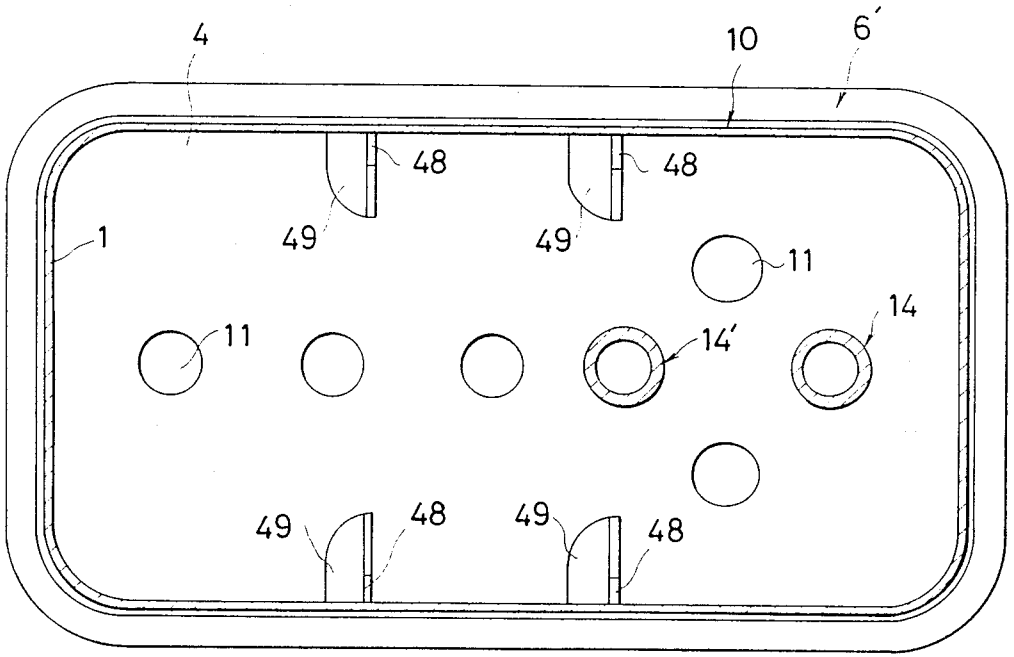
FIG. 10 is a sectional view taken along the line X—X of FIG. 9.
Figure 11:
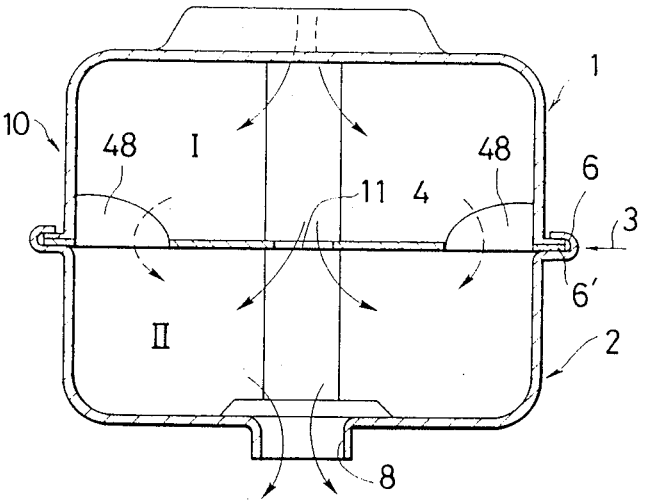
FIG. 11 is a sectional view taken along the line XI—XI of FIG. 9.

With respect to FIGS. 9, 10 and 11, which illustrate different views of a fifth preferred embodiment of the present invention, a largely rectangular hollow box-like muffler 10 includes a pair of a hollow upper and lower half section 1 and 2. A perforated baffle plate 4 is mounted between the upper and lower shell sections 1 and 2 dividing the interior of the muffler 10 into an upper chamber I and a lower chamber II. A plurality of perforations 11 are defined in the baffle plate 4. An exhaust inlet port 7 is formed in a top end portion of the upper shell section 1. The inlet port 7 is coupled in fluid-flow communication with an internal combustion engine, not shown, through an exhaust duct, not shown, to receive the exhaust gases from the engine. An exhaust outlet port 8 is defined in a bottom portion of the lower shell section 2.

With the above-mentioned arrangement, the exhaust gases entering the muffler 10 at the inlet port 7 first flow into the chamber I, then pass into the chamber II through the perforations 11, and are forced out to the atmosphere via the outlet port 8. In the process of passage from the inlet to exhaust port of the muffler 10, the gases alternately expand and contract, reducing in pressure and speed with a resultant drop in exhaust noise.

The muffler 10 may be installed on a vehicle by means of bolts 15 through bolt holes 14 and 14' extending from end to end in the muffler 10. Each of the bolt holes 14 and 14' is comprised of a set of three holes put together in vertical alignment, defined in the top wall of the upper shell section 1, the baffle plate 4 and the bottom wall of the lower shell section 2, respectively. A pair of tubular reinforcement members 14*a* and 14'*a* may preferably be provided to enclose the bolt holes 14 and 14', respectively. The provision of the reinforcement membes 14*a* and 14'*a* would not only contribute to increasing the structural rigidity of the muffler 10, but also serve to prevent external leakage of the exhaust gases in the muffler 10 through opposite ends of the bolt holes 14 and 14'. Also, a pair of collars 13 are engaged in the top end edge of the bolt holes 14 and 14', made integral with the top wall of the upper shell section 1. The collars 13 are also provided, to contribute an increase in the interlocked rigidity of the muffler 10.

It will be easily appreciated that the muffler 10 according to the embodiment depicted in FIG. 9 can be built easily into simple structure by caulking alone, without having recourse to welding or bolting, enabling assembling to be made at low cost. All of its main components—an upper and lower shell sections 1 and 2, a baffle plate 4, tubular reinforcement members 14*a* and 14'*a* and collars 13—can be produced by stamping or other simple press forming. In assembling, the upper and lower shell sections 1 and 2 are put together end-to-end in such a manner that the flat flange 6' is inserted into the U-fold of the upturned flange 6, with the periphery of the baffle plate 4 interposed between the flanges, pressures are applied, as by a pair of rollers 45 and 46 depicted in 14, across the upturned flange 6 until the flange 6 is compressed enough to firmly clasp the other flange 6' and baffle plate 4. The rollers 45 and 46 are operated to run all way around the muffler 10 so that the opposite flanges 6 and 6' are compressed into a circumferential seam. The tubular members 14*a* and 14'*a*, along with the collars 13, are pressed into positions into their respective bolt holes 14 and 14'.

Figure 14:
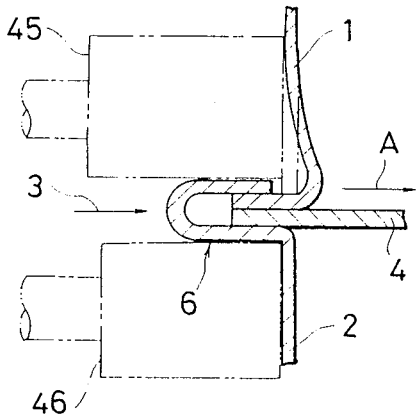
FIG. 14 PRIOR ART
FIG. 14 is a partial, cross-sectional view of the opposite flanged edges of half shell sections, showing how caulking rollers are operated to close the edges.

A plurality of propping members 48 are provided in the baffle plate 4 along each of its longer sides. It is important to note that the propping means 48 are situated, as can be best illustrated in FIG. 10, that. during muffler assembling by caulking, the propping means 48 stand to line up immediately adjacent to the corresponding sides of the upper shell section 1 skirting the flat flange 6' to be caulked. The propping means 48 are provided to avoid difficulties often encountered with the prior art mufflers when they are assembled by caulking. With conventional mufflers, particularly of larger size, when caulking pressures are applied across the flanges 6 and 6', as by rollers 45 and 46 in FIG. 14, the very pressures tend to work to push the side of the upper shell section 1 inwardly in the arrowed direction (FIG. 14) forcing the flange 6' out of caulked position in the upturned flange 6, with a resultant incompletely caulked or, in an extreme case, uncaulked seam. This buckling tends to occur particularly often at the middle of the longer sides of the shell. The propping means 48 are formed in positions so that they stand to abut against the longer sides of the upper shell section 1 to thereby preventing the side from inwardly warping during caulking.

Figure 12:
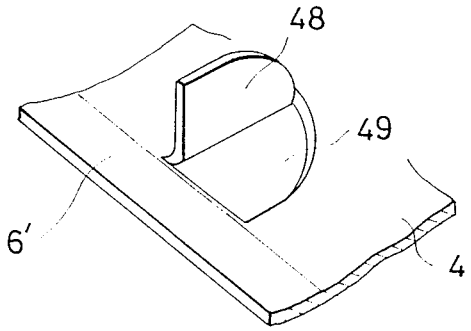
FIG. 12 is a perspective partial view of a baffle plate in the muffler according to the present invention, showing an anti-slip stopper in the form of a cutout in the plate surface to prevent the muffler half shell section from inward deformation under caulking pressure.
Figure 13:
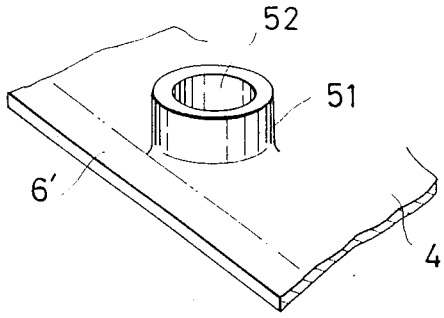
FIG. 13 is a perspective partial view of a baffle plate in the muffler, with a modification of the anti-skid stopper of FIG. 12 in the form of a stub.

It is to be noted, however, that the illustrated location of propping means 48 in FIG. 10 should not limit the embodiment of the invention. Alternatively, additional flaps 48 may be formed along both or one of the shorter sides of the baffle plate 4. In this particular embodiment, the propping means 48 are formed in the form of flaps cut out in the baffle plate 4. However, the propping means 48 may be provided in any other possible form to give the same effect. For example, the propping means 48 may be annular stubs 51, formed by barring, as depicted in FIG. 13. In either of the described modifications of the propping means, flaps 48 or stubs 51, their formation may produce perforations 49 lower (FIG. 12) or 52 (FIG. 13). The perforations 49, 52 also serve, along with the perforations 11, to allow the exhaust gases to pass from the chamber I to chamber II. It will be understood that the formation of propping means 48, 51 does not add much to manufacturing costs, since they can be provided in the same press forming operation as to produce the baffle plate 4. Although, the above description focuses on mufflers of larger size, it must be understood that the present embodiment can also be applied to small mufflers.

What is claimed is:

1. A muffler for internal combustion engines comprising:

a hollow airtight shell body assembled from a pair of an upper shell section and a lower shell section, an exhaust inlet port defined in the upper shell section, the inlet port being adapted for connection with an exhaust duct from an internal combustion engine, an exhaust outlet port defined in the lower shell section;

a pair of spaced apart first and second perforated baffle plates mounted in the shell body between the upper shell section and lower shell section and having opposite buldged portions thereof defining a buldge shape;

a first expansion chamber defined in the upper shell section above the first perforated baffle plate, a first gas passage having a first end and a second end defined to extend longitudinally in the upper shell section and having the first end thereof connected to the first expansion chamber;

a second expansion chamber defined in the lower shell section below the second perforated baffle plate, a second gas passage having a first end and a second end defined to extend longitudinally in the lower shell section and having the first end thereof connected to the second end of the first gas passage, the second end of the second gas passage being connected to the second expansion chamber;

a third expansion chamber defined in the shell body between said opposite bulged portions in the first and second perforated baffle plates, and a third gas passage having a first end and a second end defined to extend longitudinally in the shell body and having the first end thereof connected to the second end of the second gas passage, the second end of the third gas passage being connected to the third expansion chamber, whereby the exhaust gases from the engine are caused to undergo a repeated series of contraction and expansion as said cases move successively from the first expansion chamber into the second expansion chamber then into the third expansion chamber before leaving the shell body through the outlet port;

a pair of first and second circumferential outwardly extending flanges formed along opposite open ends of the upper and lower sections, the paired first and second circumferential flanges being bonded to each other by caulking, with the first and second baffle plates being interposed between the flanges, integrating the upper and lower shell sections into a whole shell structure, and reinforced members mounted in the shell body and extending through one or more of the passages and chambers in such a manner as to integrally join each of the first and second baffle plates with portions of the upper and lower shell sections in to an interlocked airtight structure.

2. A muffler as set forth in claim 1, wherein the reinforcement members comprise combinations of rigid and resilient members.

3. A muffler as set forth in claim 1, wherein the opposite bulged portions in the first and second perforated baffle plates define in combination a substantially spherical space located at one end of the shell body.

4. A muffler as set forth in claim 3, wherein the bulged portion of the first baffle plate has at a top portion thereof an outwardly protruding dome-like bulge formed, and the upper shell section has a recess defined therein at a location just opposite the dome-like bulge, the recess being sized and shaped so as to fittingly brace the dome-like bulge therein, integrating thereby the upper shell section with the first and second baffle plates into an interlocked rigid structure.

5. A muffler as set forth in claim 3, wherein an aperture is defined in a top portion of the bulged portion of the second baffle plate at a location just opposite the outlet port, the aperture having a peripheral portion thereof integrally secured to the outlet port, opening the spherical space to the atmosphere.

* * * * *